United States Patent [19]

Noyon

[11] 4,023,719

[45] May 17, 1977

[54] HOPPER CLOSING AND EMPTYING DEVICE

[75] Inventor: Gustave Maurice Noyon, Paris, France

[73] Assignee: Societe Internationale d'Investissements et de Participations (Interpar), Paris, France

[22] Filed: Nov. 7, 1975

[21] Appl. No.: 629,991

Related U.S. Application Data

[63] Continuation-in-part of Ser. No. 504,836, Sept. 10, 1974, abandoned.

[30] Foreign Application Priority Data

Sept. 12, 1973 France ..... 73.32744

[52] U.S. Cl. ..... 222/505; 105/284; 105/304; 222/556

[51] Int. Cl.[2] ..... B65G 65/62; B65G 65/66

[58] Field of Search ..... 222/505, 556; 251/280; 105/284, 299, 304, 308 E

[56] References Cited

UNITED STATES PATENTS

| | | | |
|---|---|---|---|
| 2,079,392 | 5/1937 | Yost | 105/284 X |
| 3,511,188 | 9/1967 | Danielson | 105/299 X |
| 3,577,932 | 5/1971 | Pulcrano et al. | 105/299 X |
| 3,807,316 | 4/1974 | Miller | 105/299 X |

*Primary Examiner*—Stanley H. Tollberg
*Assistant Examiner*—Francis J. Bartuska
*Attorney, Agent, or Firm*—Eric P. Schellin; H. Karl Saalbach

[57] ABSTRACT

A door for opening and closing the discharge opening of a hopper is carried by a support suspended from an oblique lateral wall of the hopper by two links pivoted to the support at one end and pivoted to the support at the other end of the links. An actuating and locking mechanism for the door is connected to the support. The support has a generally triangular shape and the two pivotal connections between the links and the support are in the vicinity of two of the corners of the triangle. The door is located in the vicinity of the third corner of the triangle.

9 Claims, 3 Drawing Figures

HOPPER CLOSING AND EMPTYING DEVICE

This application is a Continuation in Part of application Ser. No. 504,836, filed Sept. 10, 1974 now abandoned.

The present invention relates to devices for closing the lower opening of hoppers and for emptying hoppers.

When a hopper is employed for loading containers, for example, buckets of vehicles whose capacity is substantially less than the capacity of the hopper, a device must be provided for effecting a controlled emptying, that is to say, for allowing a partial adjustable opening of the emptying opening of the hopper and a better closing thereof when the hopper has been emptied of a sufficient amount of its contents and the loading has finished. Two types of such devices are known:

The first or "sliding" type comprises a planar or cylindrical trap door and means for shifting this trap door in a direction parallel to itself, in a translation in its plane if the trap door is planar, or in rotation about its axis if it is cylindrical. The guide means may be of the type in which two similar surfaces rub against each other or of the type having rollers which reduce the forces required for the opening and closing operations. However, this type of device is imperfect in operation and unsuitable when the products handled are adhesive or corrosive or both. Moreover, the guide means are liable to become jammed or be wedged and this might hinder correct operation of the device.

The second known type of device, namely, the "helmet" type of device, comprises mainly a trap door, the helmet, which is mounted in such manner as to be swingable about an axis which is sufficiently remote from the hopper opening that the door moves away from its seat, constituted by the base of the hopper, in a direction making a large angle with its surface. The trap door thus moves away in a definite manner right from the start of the opening operation and avoids any friction. Such a device operates just as satisfactorily, for adhesive or corrosive products and normal products. However, in the case of large-capacity hoppers, the moment due to the pressure that the product contained in the hopper exerts on the door, which tends to open the door, is very great. In order to achieve a controlled opening of the hopper, it is necessary to provide either a jack or cylinder device, or a very large gearing down or speed reduction in the handling mechanism which complicates the latter and results in a substantially longer time for opening and closing. The long operating time is a serious drawback.

There is a variation of the last-mentioned type of device in which two half-doors are each suspended from two sets of links respectively disposed on each side of the hopper. This arrangement, apart from complicating the construction owing to the presence of the two half-doors, has the following very serious drawback: it can only be employed if the distance between the two sets of links associated with the same half-door is small. If the opening of the hopper is of great width it is necessary to provide a plurality of sets of doors and provide one or more intermediate spaces for receiving the sets of corresponding links. This complicates the construction, adds to the shortcomings, and decreases the capacity of the hopper. Moreover, the four sides of the latter are encumbered, some being encumbered by the sets of links and others by the cylinder devices or other actuating means. In particular, such an arrangement cannot be envisaged in the application to a storing and transporting machine, such as that described in French Pat. No. 2,257,458 and its Addition No. 2,271,069, or in a wagon for transporting manure or other powdered products which are to be discharged laterally.

None of the known devices, therefore, gives satisfaction in all the cases of utilization and the object of the present invention is to provide a device which permits effecting a controlled emptying of a hopper by rapid opening and closing movements which is simple in construction and suitable irrespective of the type of product handled and the type of hopper with which it is associated.

This result is obtained according to the invention by a closing and emptying device for a hopper comprising a door adapted to close the emptying opening of the hopper, link suspension means connecting the door to a fixed frame of the hopper, and an actuating and locking mechanism, wherein the door is integral with a support which has a generally triangular shape and which is suspended under an oblique lateral side of the hopper by two links pivotally connected to the support in the vicinity of two of the corners of the triangle, the door being located in the vicinity of the third corner of the triangle which is remote from the first two mentioned corners wherein the actuating and locking mechanism is connected to the support.

According to a preferred embodiment, the actuating and locking mechanism is of the toggle type and comprises a link which constitutes a first arm of the toggle and is pivotally connected to the support between the support and the main pivotal connection between the arms of the toggle, and a lever having a branch which constitutes the second arm of the toggle and extends from said main pivotal connection of the toggle and is pivotally mounted on a fixed pin, the lever having a second branch constituting an actuating means.

Further features and advantages of the invention and its operation will be described hereinafter with reference to the accompanying drawings given by way of example and in which.

Figure 1:
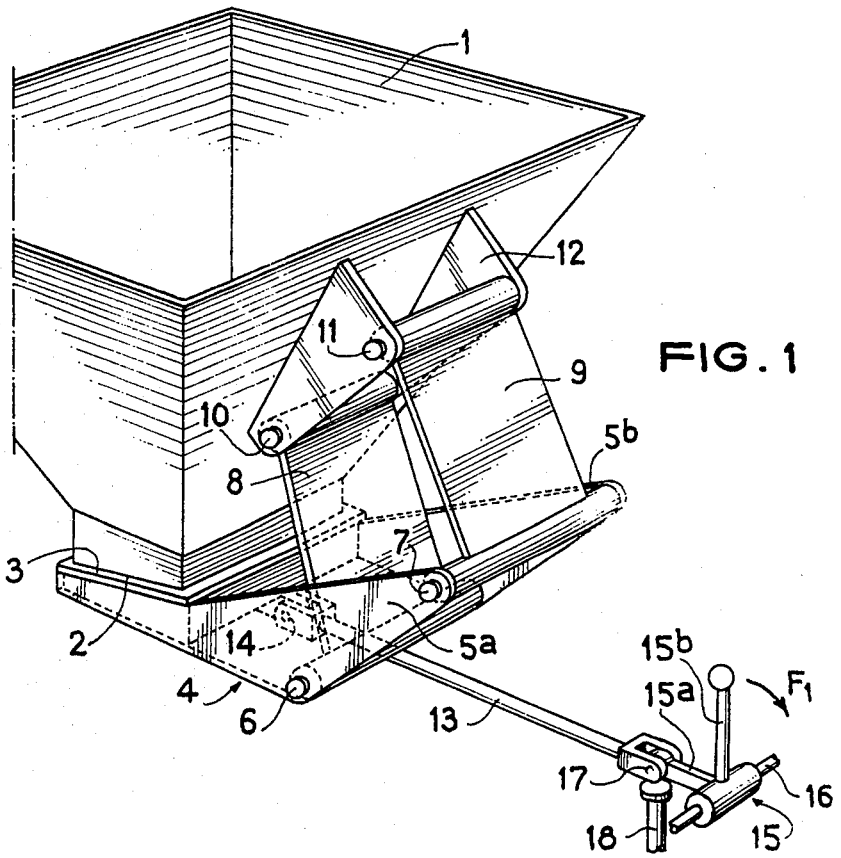
FIG. 1 is a slightly diagrammatic perspective view of a device according to the invention.

FIG. 1 shows a hopper 1 comprising in its lower part an emptying opening 2 which may have a planar or cylindrical shape, this opening being closed by a trap door of the helmet type. This door has, of course, a shape corresponding to that of the opening of the hopper and, in the illustrated example, the line of contact between the door and the lower edge of the opening describes a rectangle and is contained in a plane. The door 3 is carried at the end of a laterally offset support 4 which is constituted, in the embodiment shown in FIG. 1 by two identical side walls 5*a*, 5*b* which have a roughly triangular shape and are interconnected by two shafts 6, 7 located at two of the corners of the triangle. These corners are remote from that portion or corner of the support at which the door is located. The support is suspended by two non-parallel links 8 and 9 which are pivotally connected at one of their ends by shafts 10 and 11 to the fixed frame 12 to define a first and second axis and at their other ends by pins 6 and 7 to a support 4 to define a third and fourth axis. The fixed frame is mounted on an oblique side wall of the hopper as shown.

The device further comprises an actuating and locking mechanism constituted by a link or connecting rod 13 pivoted at one end to the door or its support by a yoke and pivot pin 16. This mechanism is of the toggle type, the two arms of which are constituted by the link or connecting rod 13 and the branch 15*a* of the lever 15 which are pivotally interconnected by a main pivotal connection or pin 17. The second branch 15*b* of the lever 15 constitutes an actuating means. There is provided a fixed abutment 18 which determines the position of the actuating mechansim corresponding to the closure of the hopper opening by the door 3. This abutment is so disposed that the toggle comes in contact with the upper surface of the abutment after having passed through its dead-centre position. In the dead-centre position, the connecting rod 13 and the branch 15*a* are in a straight line with each other.

The operation of this device will now be explained with reference to FIGS. 1 and 2.

In the closed hopper position shown in FIG. 1, the toggle is positioned slightly beyond its position of dead-centre and is in contact with the fixed abutment 18. The vertical downwardly-directed force that the product exerts on the door 3 and the moment which results therefrom tends to urge the connecting rod 13 toward the right with reference to FIG. 1 but a downward displacement of the pivotal connection 17 is prevented by the abutment 18. To achieve a progressive opening of the hopper, it is necessary to shift the actuating lever in the direction of arrow F1 (FIG. 1) so as to rotate the main pivotal connection of pin 17 of the toggle about the fixed pin 16 causing the toggle to pass through its dead-centre position.

Figure 2:
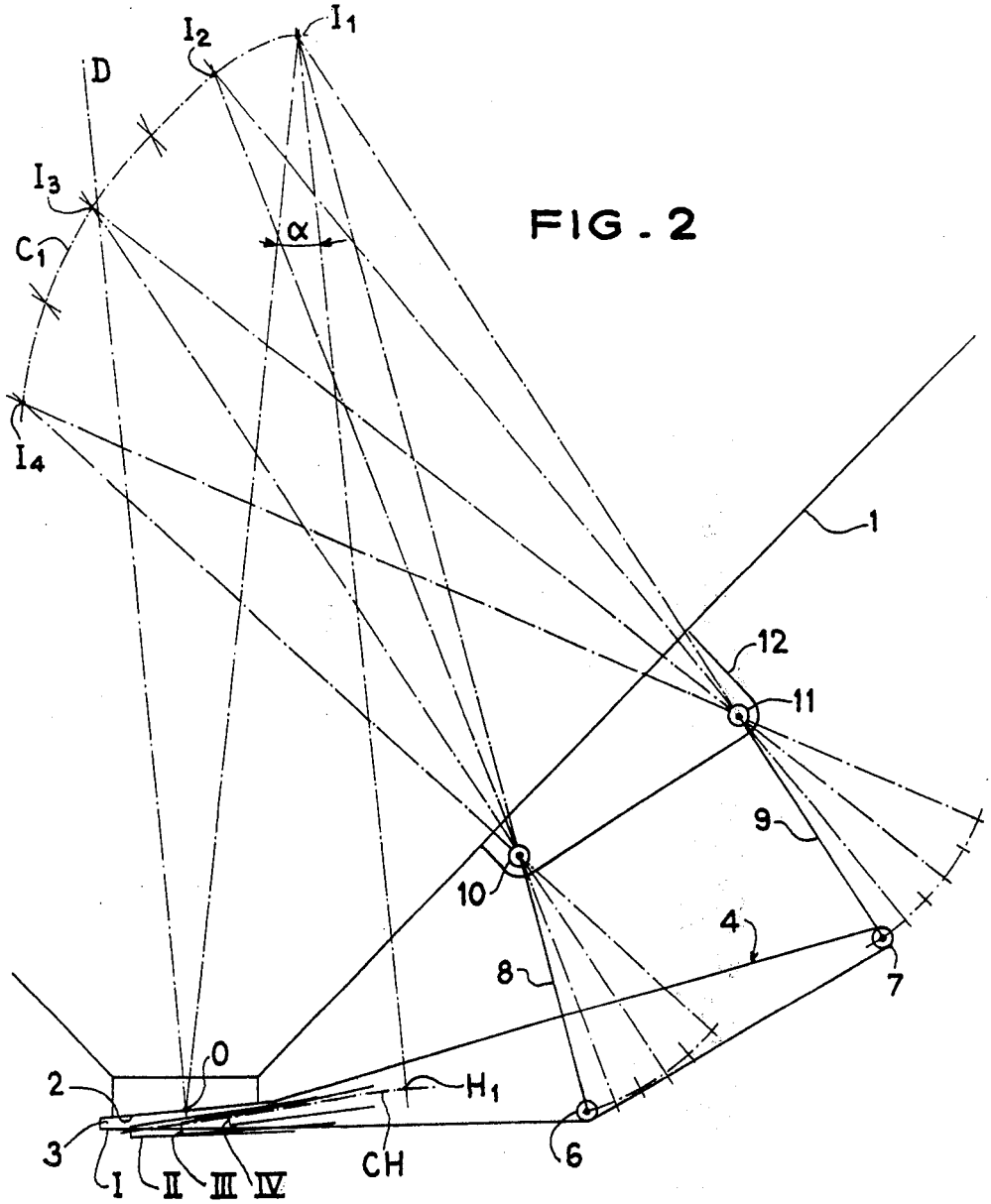
FIG. 2 is a diagram showing several successive positions of parts of the device.

With reference now to FIG. 2, the successive positions of the main parts of the device will now be examined as the actuating arm or handle is swung in the direction of arrow F1. First, in the closed position, it can be seen that the instantaneous centre of rotation of the support and consequently of the door 3, designated by the reference $I_1$ which is locted at the intersection of the straight lines along which the links 8 and 9 extend, is placed relatively high up with respect to the level of the door and is offset with respect to the perpendicular D to the mean plane of the door through the centre O of the latter. This causes the angle $\alpha$ which is made in this position by the straight line $I_1$ and the perpendicular $I_1H$ dropped from $I_1$ to the mean plane of the door to be about 15°. This is sufficient to ensure, in the course of the opening movement, that the shifting of the door from the position I occurs in such manner that it moves away and disengages from its seat. This is clear with reference to the next instantaneous position II shown in FIG. 2. In the course of this initial stage of the opening, it is true that the moment which results from the weight of the product and tends to open the door has an appreciable value, but the mechanical advantage afforded by the toggle mechanism in this position is maximum because of the alignment of link 13 and branch 15*a* and is sufficient to enable the user to easily resist this opening moment.

In pursuing the opening movement, the instantaneous centre of rotation moves along a curve $C_1$ represented in dot-dash line in FIG. 2, whereas the lower end of the perpendicular dropped from this centre onto the mean plane of the door moves toward the left as viewed in the drawing along a curve CH so that the angle $\alpha$ very rapidly decreases. The moment tending to open the door thus very quickly decreases and has, during the rest of the opening operation, a very small value which can only give a very slight tendency to open the door or even to close the door, according as the point H in the vicinity of the centre of thrust of the product is located between this centre of thrust and the link 8 or the centre of thrust is located between the point H and said link.

In the course of the closing movement it is the inverse procedure which occurs, that is to say, at the start of this closing movement the mechanical advantage afforded by the toggle is relatively small because of the angle between elements 13 and 15*a* but the resisting force, due to the moment exerted by the product, has itself a very small value. On the other hand, when at the end of the closing travel the moment due to the weight of the product increases, the mechanical advantage afforded by the toggle also increases so that the closing force required remains within normal limits. It will be appreciated that this closure can be achieved very rapidly since no conventional gearing-down or other speed reducing mechanism is necessary.

Figure 3:
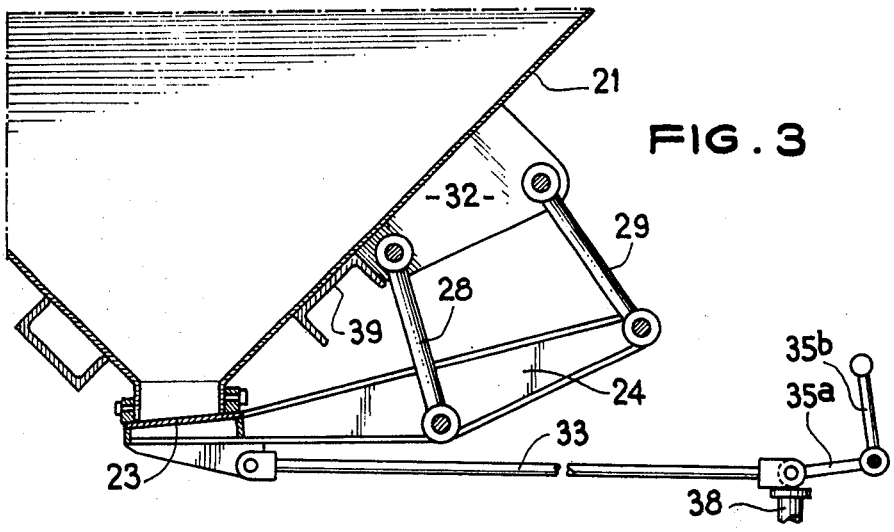
FIG. 3 is a sectional view of a specific embodiment of the invention.

FIG. 3 shows an embodiment very similar to that shown in FIG. 1 in which elements similar to those shown in FIG. 1 carry corresponding reference numerals increased by 20. The hopper 21 is such that the corner defined by two opposed walls is equal to 90°. The device for suspending the support is constituted by sets of links 28, 29 of equal length which facilitates manufacture and assembly. These links may be four in number by way of a modification of the arrangement shown in FIG. 1. The bracket or fixed frame 32 to which the links are pivoted is secured to the hopper and is positioned with respect to the hopper by contact with a U-section member 39 which is part of the frame of the hopper. With this arrangment, it is certain that the mechanism is placed in position in the correct manner so that the normal manufacturing tolerances may be achieved with no inconvenience.

It is clear from the foregoing description that the device according to the invention combines the respective advantages of the various types of known devices without being of complicated construction or too expensive. On the contrary, the actuating mechanism is simplified, since, at least in respect of doors of reasonable size, no gearing down or speed reducing means is necessary. The mechanism also permits the simultaneous control of two hoppers by one operator owing to the extreme simplicity of operation and the small actuating force required. However, it is clear that in the case of doors of large size, simple gearing down or speed reducing means may be incorporated in the device which will nonetheless continue to perform the aforementioned advantageous function.

It will be appreciated that the presence of a support permits laterally offsetting the links and requires only two links which are placed under an inclined lateral wall rather than on each side of the hopper. This is of particular advantage in the case of hoppers having great length or multiple openings, and in particular in the case of a laterally unloaded wagon or truck.

Having now described my invention, what I claim as new and desire to secure by Letters Patent is:

1. A device for opening and closing a hopper, said hopper having a lower discharge opening and an oblique lateral wall, said device comprising:

a support located under said oblique wall and said lower discharge opening;

a door attached to said support adjacent one end of said support;

a fixed frame attached to said oblique wall;

two links comprising the sole means for suspending said support, one end of each of said links connected to said fixed frame to pivot about a first and second axis, and an opposite end of each of said links connected to said support to pivot about a third and fourth axis; and an actuating and locking mechanism connected to said support and located on the same side of the hopper with respect to said discharge opening as is the fixed frame, the disposition of said one end of the support and said third and fourth axis being such that the said one end of the support is remote from the third and fourth axis and lines connecting the third axis, the fourth axis, and the said one end of the support define a triangle.

2. The device of claim 1 wherein said links are nonparallel and are located along first and second lines which meet at a point above said discharge opening, and an angle $\alpha$ is formed between a third line extending from said point to the midpoint of said door and a fourth line extending from said point so as to be perpendicular to the plane of said door, the first and second lines during the opening of the door causing said point to describe a curved path and said angle $\alpha$, as defined, to rapidly decrease.

3. The device of claim 2, wherein said angle $\alpha$, in the closed position of said door, is approximately 15°.

4. The device of claim 1, wherein said actuating and locking mechanism includes a link, a pivoted lever, and an abutment, said pivoted lever including a branch pivotably connected to said link, whereby in the closed position said abutment is operative to restrain said actuating mechanism from movement caused by forces on said door.

5. A device for opening and closing a hopper, said hopper having a lower discharge opening and an oblique lateral wall, said device comprising:

a support located under said oblique wall and said lower openings;

a door attached to said support adjacent one end of said support;

a fixed frame attached to said oblique wall;

two sets of links comprising the sole means for suspending said support, one end of each of said links connected to said fixed frame to pivot about a first and second axis, and an opposite end of each of said links connected to said support to pivot about a third and fourth axis;

said third and fourth axis being remote from said one end of the support and laterally offset from said lower discharge opening so as to be located on the same side of the hopper with respect to said lower opening as is the fixed frame; and an actuating and locking mechanism connected to said support and located on the same side of the hopper with respect to said lower opening as is the fixed frame, the third axis, and the fourth axis being located at corners of the support, the corners defining a triangle with said one end of the support.

6. The device of claim 5 wherein each set of links comprises two links.

7. The device of claim 5 wherein the links comprising the two sets of links are all of equal length.

8. The device of claim 5 wherein said actuating and locking mechansim comprises a toggle structure, two arms and a main pivotal connection between the arms, one of the arms being pivotally connected to the support, the other of the arms constituting the branch of a lever mounted to pivot about an axis which is fixed relative to the hopper, further including an abutment, said abutment contacting said main pivotal connection to restrain said connection from movement caused by forces acting on said door, and said lever having a second branch constituting means for shifting said lever about the fixed axis.

9. The device of claim 8 wherein said toggle structure passes to an extreme position beyond a dead center position in which the two arms are in alignment with each other, said extreme position corresponding to a closing of said door against said discharge opening.

* * * * *